US005284362A

United States Patent [19]

Kachel et al.

[11] Patent Number: 5,284,362

[45] Date of Patent: Feb. 8, 1994

[54] REINFORCED SHELF FILING FOLDERS

[75] Inventors: Theodore V. Kachel, Purchase, N.Y.; Jonathan B. Rivlin, East Brunswick, N.J.; Lee A. Boy, Staten Island, N.Y.; Robert E. Hawes, Jr., Huntington Bay, N.Y.; Cheryl Dellacroce-Steinberg, Jericho, N.Y.; Eric Aaldenberg, Bayside, N.Y.; James J. Lynch, Berkley Heights, N.J.

[73] Assignee: Esselte Pendaflex Corporation, Garden City, N.Y.

[21] Appl. No.: 855,078

[22] Filed: Mar. 23, 1992

Related U.S. Application Data

[63] Continuation-in-part of Ser. No. 769,001, Sep. 30, 1991, which is a continuation of Ser. No. 483,094, Feb. 21, 1990, Pat. No. 5,066,045.

[51] Int. Cl.[5] ..... B42D 3/00

[52] U.S. Cl. ..... 281/45

[58] Field of Search ..... 40/359, 360; 281/45, 281/46, 47, 48; 229/1.5; 493/947

[56] References Cited

U.S. PATENT DOCUMENTS

| | | | |
|---|---|---|---|
| 2,291,724 | 8/1942 | Jonas | 129/16.7 |
| 3,779,393 | 12/1973 | Grundell | 211/126 |
| 3,933,294 | 1/1976 | Meenan et al. | 229/1.5 R |
| 4,031,646 | 6/1977 | de Nouel | 40/359 |
| 4,053,057 | 10/1977 | Snowden | 211/126 |
| 4,284,227 | 8/1981 | Corey | 229/1.5 R |
| 4,523,776 | 6/1985 | Barber | 283/39 |
| 4,580,815 | 4/1986 | Barber | 283/81 |
| 4,749,121 | 6/1988 | Barber | 229/1.5 R |
| 4,806,397 | 2/1989 | Horwitz | 428/14 |
| 4,830,268 | 5/1989 | Pitts | 229/68 R |
| 4,966,639 | 10/1990 | Pfeffer et al. | 156/359 |
| 5,025,978 | 6/1991 | Pacione | 40/359 X |
| 5,066,045 | 11/1991 | Hawes, Jr. et al. | 281/45 |

FOREIGN PATENT DOCUMENTS

| | | |
|---|---|---|
| 563159 | 12/1957 | Belgium . |
| 630978 | 11/1963 | Belgium . |
| 1103716 | 6/1981 | Canada . |
| 1197155 | 11/1985 | Canada . |
| 1216486 | 1/1987 | Canada . |
| 1221600 | 5/1987 | Canada . |
| 1233721 | 3/1988 | Canada . |
| 1236472 | 3/1967 | Fed. Rep. of Germany . |
| 1463195 | 11/1966 | France . |
| 2300685 | 10/1976 | France . |
| 2444571 | 8/1980 | France . |
| WO90/03890 | 4/1990 | PCT Int'l Appl. . |

OTHER PUBLICATIONS

Ames Color-File MEDIA Products and Accessories, 1991 pp. 2, 3, 12.

*Primary Examiner*—Mark Rosenbaum
*Assistant Examiner*—Willmon Fridie, Jr.
*Attorney, Agent, or Firm*—Pennie & Edmonds

[57] ABSTRACT

A reinforced shelf filing folder having front and rear panel members connected along a fold line and a tab member connected to a first side edge of the rear panel member. Reinforcement is applied to both sides of the tab member and to the outer surface of the fold line extending onto the adjacent surfaces of the front and rear panel members. Finally, additional reinforcement means is optionally applied to the outer surfaces of the front and rear panel members, disposed along a side portion of the rear panel member opposite the first side edge and over the fold line to a corresponding portion on the front panel member. Alternatively, the additional reinforcement can be applied to the outer and inner sides of the front panel member along the first side edge. These reinforcements increase the wear resistance and life of the folder.

30 Claims, 6 Drawing Sheets

REINFORCED SHELF FILING FOLDERS

CROSS-REFERENCE TO RELATED APPLICATIONS

This application is a continuation-in-part of application Ser. No. 07/769,001 filed Sep. 30, 1991, which is a continuation of application Ser. No. 07/483,094 filed Feb. 21, 1990, now U.S. Pat. No. 5,066,045.

BACKGROUND OF THE INVENTION

1. Field of the Invention

The present invention relates to paper office supplies, and, in particular, to shelf filing folders having reinforcement along the bottom and side edges to make the folders stronger and more durable.

2. Description of the Prior Art

Shelf filing folders are a necessary tool in the modern office or business for filing and storing documents. These folders are usually formed from a file folder blank which is cut from a web of file folder stock. The folders typically comprise front and rear panel members joined along a fold line and a tab member which is connected to the right edge of the rear panel member. The tab member is typically coplanar with the rear panel member and usually extends away from the edge of the rear panel member for a distance of approximately one inch.

Shelf filing folders are normally placed on a storage shelf such that their fold lines contact the shelf and their tab members project outwardly from the shelf. Thus, the contents of the file may be easily ascertained by reading the exposed tab member, and the folder may be easily retrieved by pulling the folder off the shelf by the tab member.

This type of file folder has become most advantageous, especially in larger filing systems, because the filing and finding of folders is faster and easier than with drawer filing systems. Also, shelf filing systems save floor space because the folders may be stored in shelves that extend up to the ceiling, thereby allowing more folders to be stored in the same amount of office space.

Shelf filing folders usually remain in a filing system for many years and during their lives are subjected to rough handling and abuse. This rough handling and abuse is similar to that described in the above-mentioned related applications, which are incorporated herein by reference. Specifically, the folders are usually overstuffed, thereby causing the fold line to stretch and experience excessive stress. Further, when the folders are placed on and removed from the storage shelf, they are usually slid along the fold crease. This sliding causes the paper along the fold line to fray and wear away, thereby weakening the folder and making it susceptible to premature tearing or bursting.

Moreover, when the folders are removed from the shelf, they are usually grasped at the tab member and pulled. This finger contact deposits oils and acids on the paper which breaks down the fibers in the paper, thereby subjecting the folder to premature tearing. The oils and acids also soil the paper, giving the folder an unsightly appearance. Very often, folders that are handled repeatedly will be discarded merely because the tab members have become soiled and unattractive.

After the folders have been removed from the shelf, they are usually transported from the file room to office workers in holding carts. During this transportation, the folders are often roughly handled and dropped into the carts. This rough handling will additionally cause the fold crease to wear away and will increase the chances of premature bursting. Further, the projecting tab member usually rubs against the side of the cart, thereby subjecting the tab member to creasing and tearing. This disfigurement adds to the unsightly appearance of a frequently used shelf filing folder.

Accordingly, there is a need for a shelf filing folder of superior strength that is stronger, more durable, is not susceptible to premature wear and tear.

SUMMARY OF THE INVENTION

In accordance with the present invention there is provided a shelf filing folder that comprises front and rear panel members separated by a fold line and a tab member adjacent a first side edge of the rear panel member. First reinforcing means is applied to both sides of an outer surface of the tab member. Second reinforcing means is applied to the outer surface of the fold line and extends onto the adjacent surfaces of the front and rear panel members. Finally, third reinforcing means is optionally applied to the outer surfaces of the front and rear panel members along a side portion of the rear panel member opposite the first side edge and over the fold line to a corresponding side portion on the front panel member. Alternatively, the third reinforcing means can be applied to the outer and inner sides of the front panel member along the first side edge. The first, second and third reinforcing means substantially increase the wear resistance and life of the folder. Advantageously, each of the reinforcing means does not overlap the others.

The folders of the invention may also include an undercut edge extending along the first side edge of the rear panel member beneath the tab member and over the fold line to a corresponding edge of the front panel member. This undercut edge may be formed integrally with the front and rear panel members as an extension which is folded upon itself and secured with an adhesive therebetween. In addition, the undercut edge may form ramp means which facilitates the removal of the folder from a shelf. The ramp means preferably has an arcuate shape which tapers from the fold line to the first side edge of the front and rear panel members, thus enabling the folder to slide over any obstructions as it is removed from the shelf.

DETAILED DESCRIPTION OF THE PREFERRED EMBODIMENTS

Figure 1:
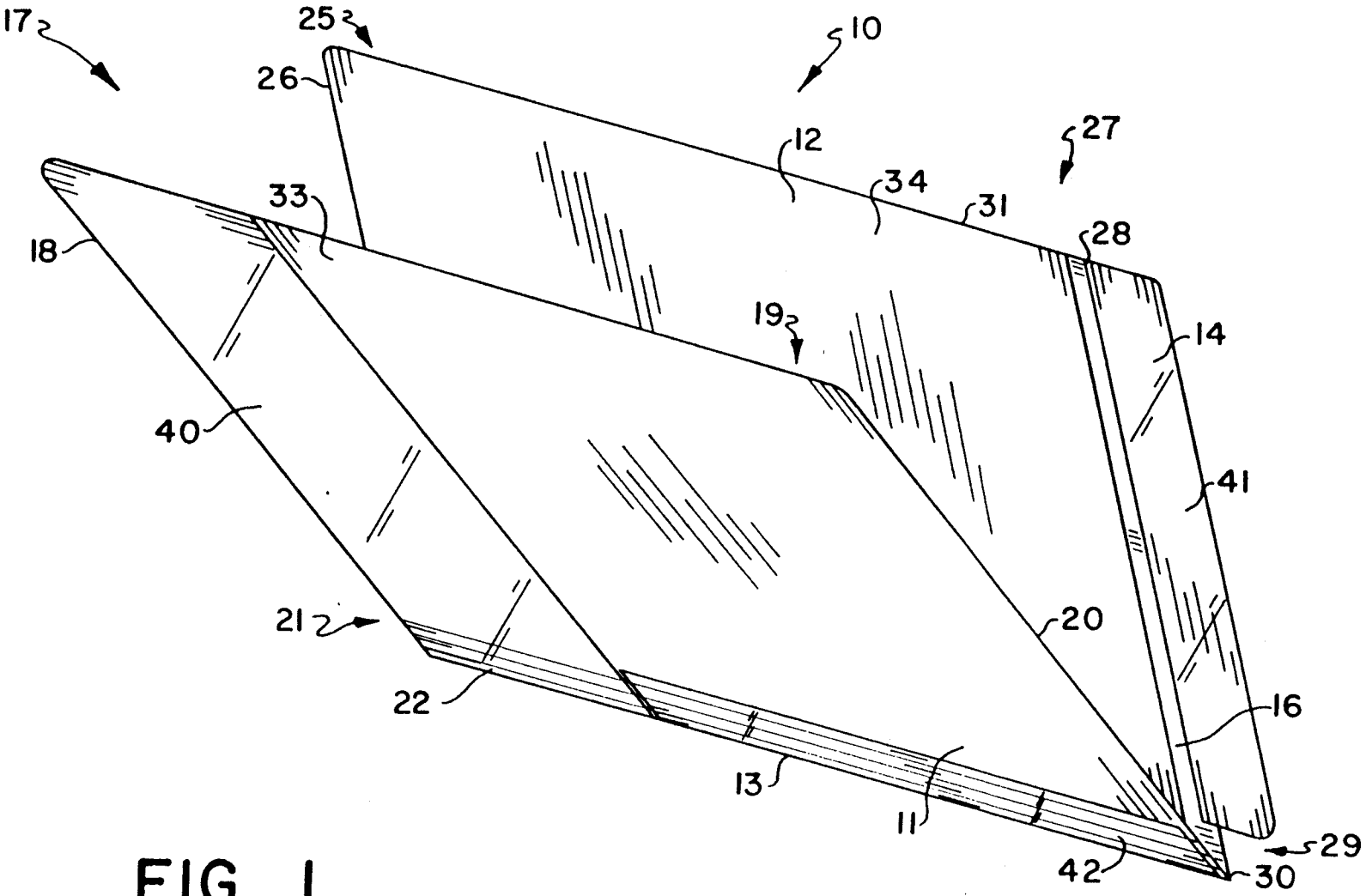
FIG. 1 is a perspective view of one embodiment of a reinforced shelf filing folder according to the present invention.
Figure 2:
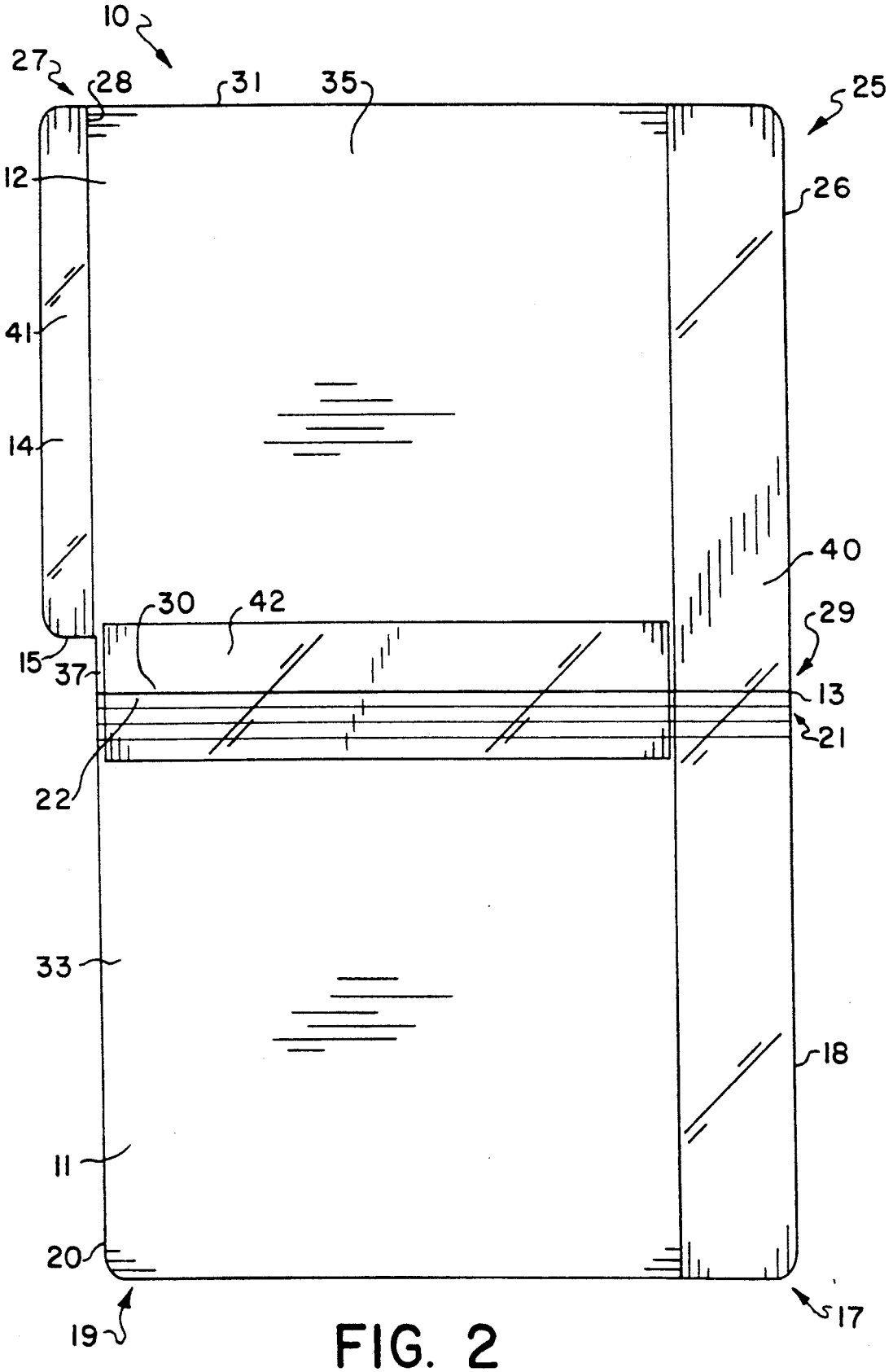
FIG. 2 is a plan view of the outer surface of the folder of FIG. 1.
Figure 3:
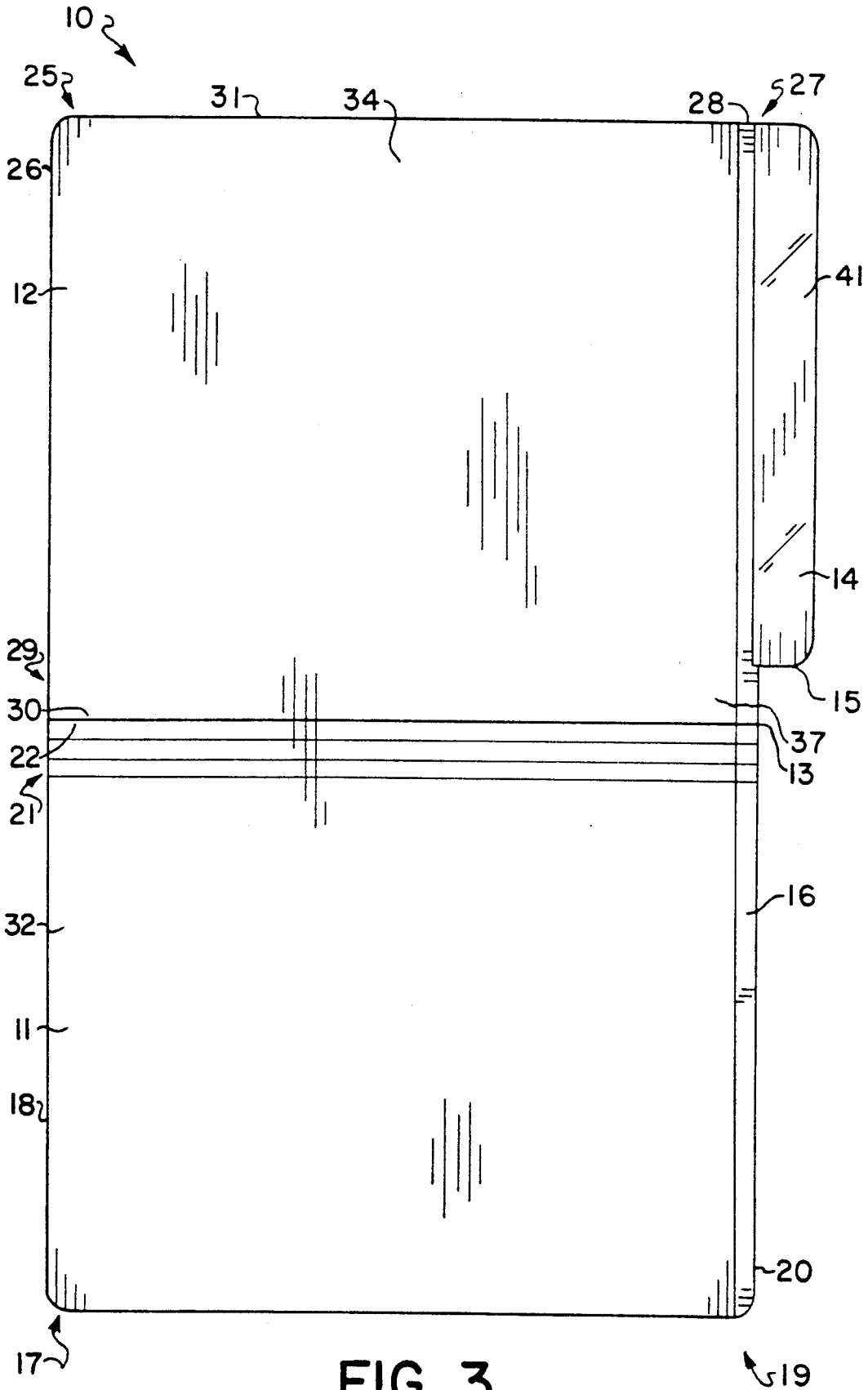
FIG. 3 is a plan view of the inner surface of the folder of FIG. 1.

Referring to FIGS. 1-3, there is illustrated a first preferred embodiment of a reinforced shelf filing folder 10 in accordance with the present invention. Folder 10 comprises a front panel member 11, a rear panel member 12, and a fold line 13 which connects front panel 11 to rear panel 12. Folder 10 further comprises a folded tab member 14, an undercut edge 16, and reinforcement layers 40, 41, 42.

Front panel member 11 comprises a left potion 17 with a left edge 18, a right portion 19 with a right edge 20, a bottom portion 21 with an edge 22, an inner surface 32 and an outer surface 33. Similarly, rear panel member 12 comprises a left portion 25 with a left edge 26, a right portion 27 with a right edge 28, a bottom portion 29 with a bottom edge 30, a top edge 31, an inner surface 34 and an outer surface 35. The bottom edges 22, 30 of front and rear panels 11, 12, respectively, are interconnected at fold line 13.

Tab member 14 is formed on right edge 28 of rear panel 12. Preferably, tab member 14 is formed from an extension of rear panel 12 that is folded over onto itself, thereby providing tab member 13 with a two-ply construction. The inner portions of the fold are secured to each other with a suitable adhesive (not shown). As shown in FIGS. 2 and 3, tab member 14 extends from upper edge 31 to just short of fold line 13. The area of rear panel 12 between lower edge 15 of tab member 14 and fold line 13, hereinafter referred to as lower portion 37, is preferably about one inch long.

Undercut edge 16 is on right edge 20 of front panel 11 and lower portion 37 of rear panel 12. Preferably, undercut edge 16 is formed from an extension of front and rear panels, 11, 12 that is folded over onto itself, thereby providing undercut edge 16 with a two-ply construction. The inner portions of the fold of undercut edge 16 are secured to each other with a suitable adhesive (not shown). If desired, undercut edge 16 may be formed simultaneously and integrally with tab member 14.

As shown in FIGS. 1 and 2, reinforcement layer 40 is applied along outer surfaces 33, 35 of front and rear panels 11, 12, respectively, along left portions 17, 25, respectively, and over fold line 13. Preferably, reinforcement layer 40 is a continuous piece of plastic film that is about two inches wide.

Another reinforcement layer 41 is applied to both sides of tab member 14 Preferably, this reinforcement layer 41 is a plastic film that extends about one inch on each side of tab member 14.

Finally, yet another reinforcement layer 42 is applied along fold line 13 and extends onto the adjacent outer surfaces 33, 35 of bottom portions 21, 29 of front and rear panels 11, 12, respectively. It is not necessary for reinforcement layer 42 to overlap either reinforcing layer 40 or reinforcing layer 41, although it can, if desired. Preferably, reinforcement layer 42 comprises a plastic film that extends along the fold line and approximately one inch on each of bottom portions 21 and 29.

When reinforcement layers 40, 41 and 42 are applied to folder 10 in accordance with the present invention, the strength, durability, and resistance to tearing of folder 10 is greatly enhanced. Reinforcement layer 40 protects left portions 17, 25 from damage when folder 10 is handled by office workers. Further, reinforcement layer 41 protects tab member 14 from creasing, tearing, and fraying when folder 10 is used. Finally, reinforcement layer 42 prevents fold line 13 from fraying and premature wear when folder 10 is placed on and removed from a storage shelf. Layer 42 will further reinforce fold line 13 if the folder 10 is overstuffed.

In addition, reinforcement layers 40, 41 and 42 will maintain the neat, attractive appearance of folder 10. When folder 10 is handled by office workers, the areas by which folder 10 is manipulated often become frayed and soiled due to finger oils and acids from the office worker's hands. However, since layers 40, 41 and 42 act as a barrier to prevent direct contact with folder 10, folder 10 will maintain its original appearance by resisting such fraying and soiling. Further, since layers 40, 41 and 42 preferably comprise a plastic film, they may easily be wiped clean should they become soiled or wet.

Figure 4:
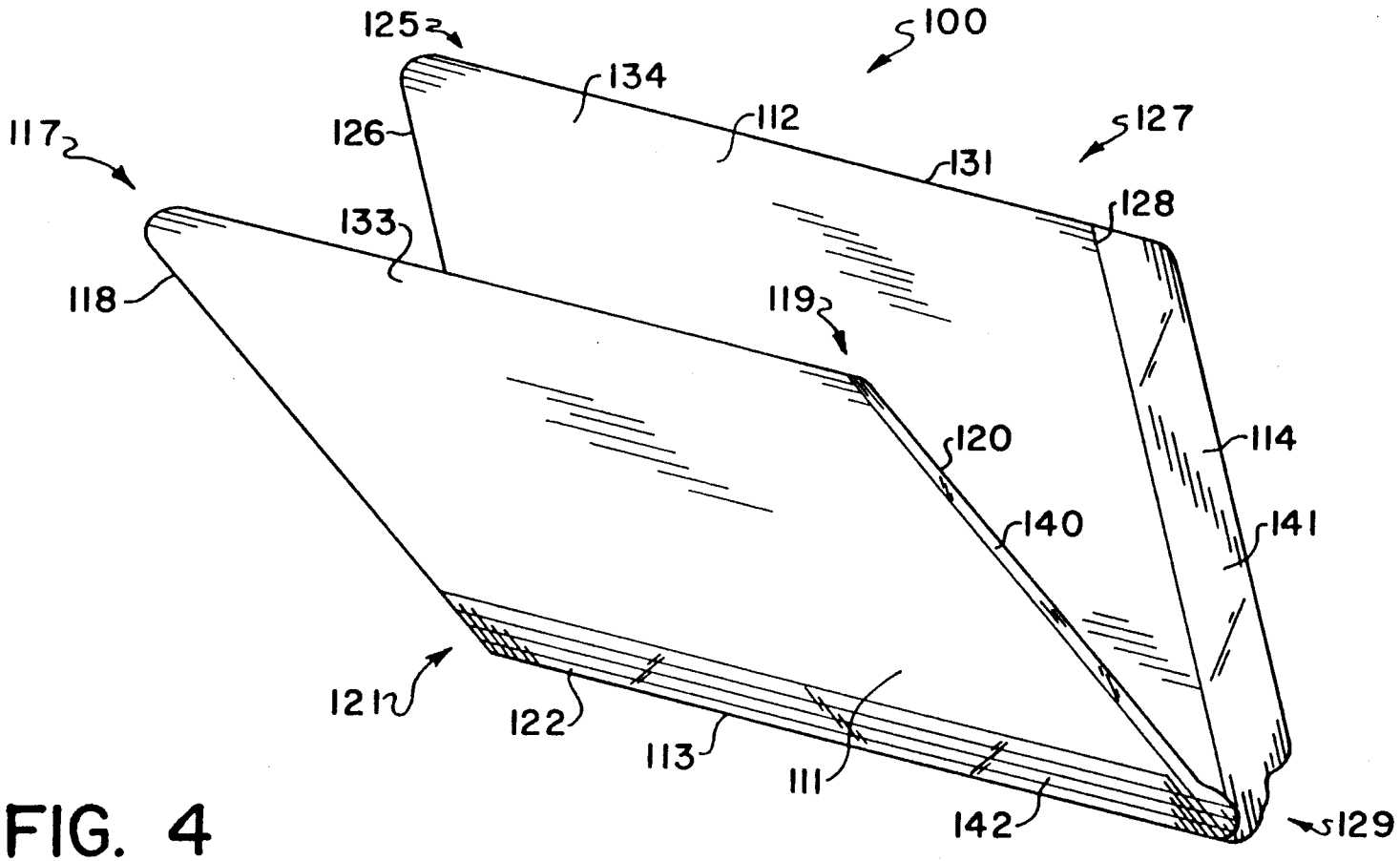
FIG. 4 is a perspective view of another embodiment of a reinforced shelf folder according to the invention.
Figure 5:
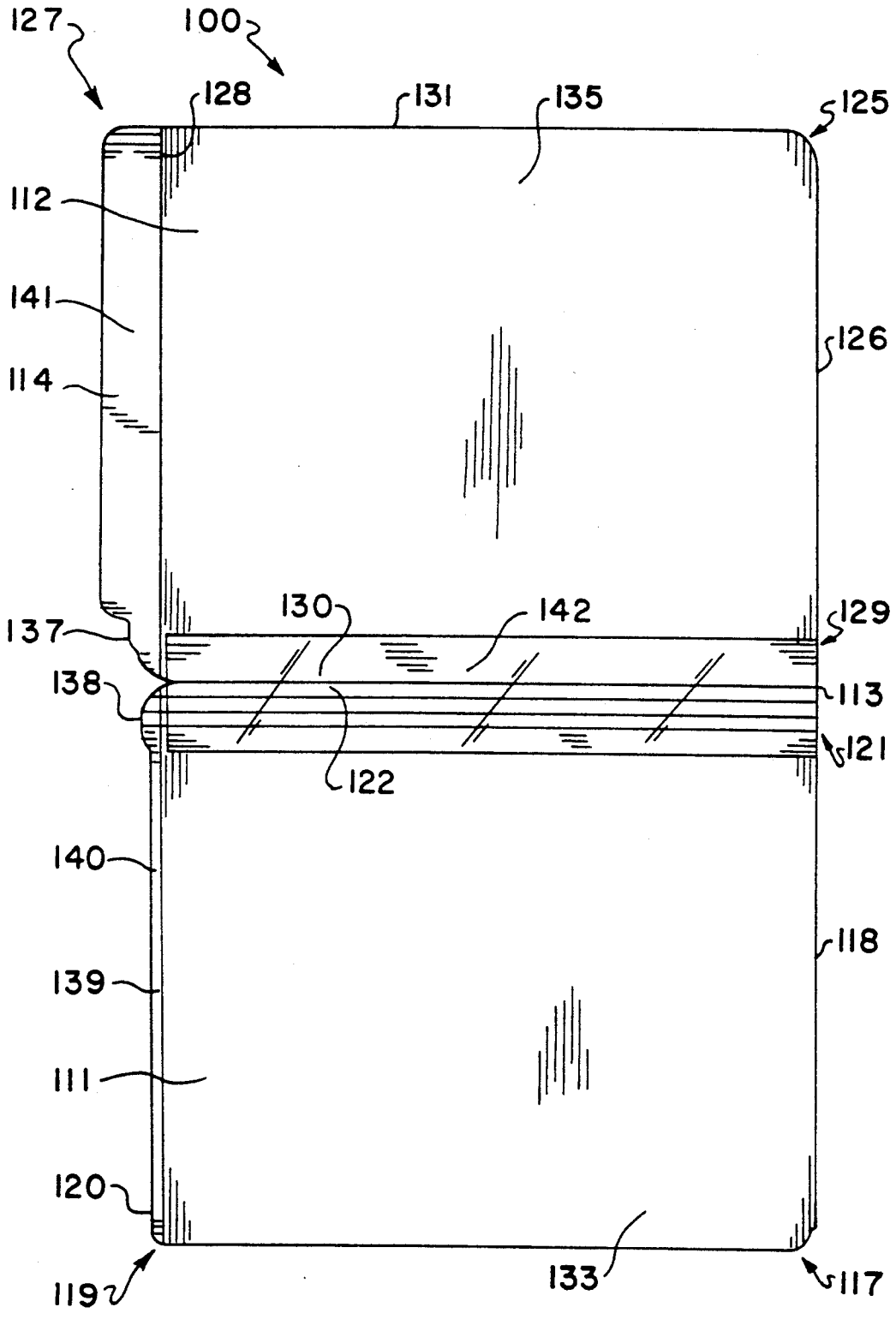
FIG. 5 is a plan view of the outer surface of the folder of FIG. 4.
Figure 6:
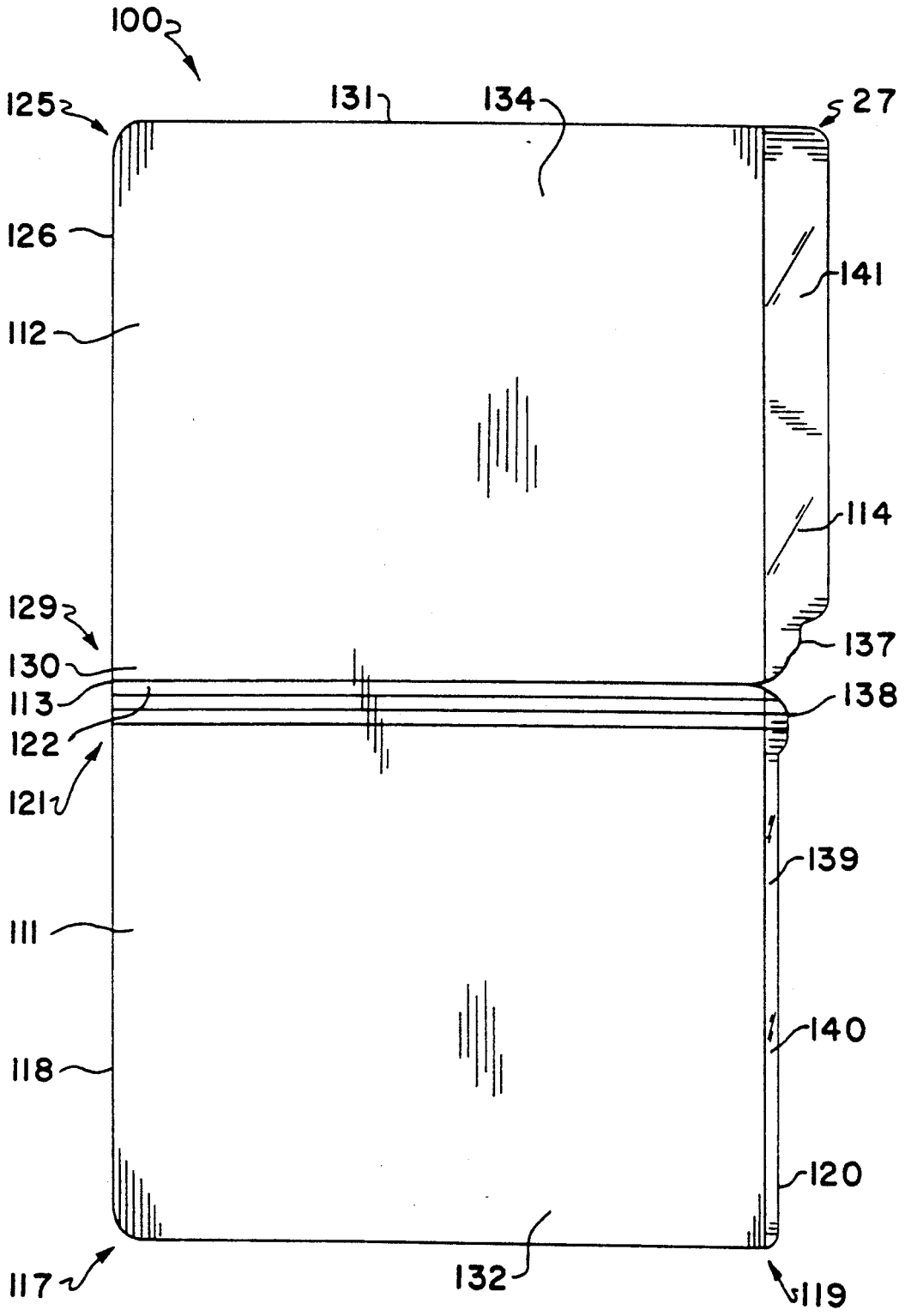
FIG. 6 is a plan view of the inner surface of the folder of FIG. 4.

Referring to FIGS. 4–6, there is illustrated a second preferred embodiment of a reinforced shelf filing folder 100 in accordance with the present invention. Where like parts to those of FIGS. 1–3 are described, the same reference numbers will be used, except that 100 will be added. Folder 100 again comprises a front panel member 111, a rear panel member 112, and a fold line 113 which connects front panel 111 to rear panel 112. Folder 100 further comprises a folded tab member 114, and reinforcement layers 140, 141, 142.

Front panel member 111 comprises a left potion 117 with a left edge 118, a right portion 119 with a right edge 120, a bottom portion 121 with an edge 122, an inner surface 132 and an outer surface 133. Similarly, rear panel member 112 comprises a left portion 125 with a left edge 126, a right portion 127 with a right edge 128, a bottom portion 129 with a bottom edge 130, a top edge 131, an inner surface 134 and an outer surface 135. The bottom edges 122, 130 of front and rear panels 111, 112, respectively, are interconnected at fold line 113.

Tab member 114 is formed on right edge 128 of rear panel 112. Preferably, tab member 114 is formed from an extension of rear panel 112 that is folded over onto itself, thereby providing tab member 113 with a two-ply construction. The inner portions of the fold are secured to each other with a suitable adhesive (not shown). As shown in FIGS. 5 and 6, tab member 114 extends from upper edge 131 to just short of fold line 113. The area of rear panel 112 between lower edge of tab member 114 and fold line 113, tapers as shown to form a ramp 137, which allows the folder to slide over obstructions when being removed from a shelf.

A corresponding ramp 138 on right edge 120 of front panel 111 near fold line 113 conforms to ramp 137 of rear panel 112. Preferably, tab member 114 and right edge 139 are formed from an extension of front and rear panels, 111, 112 that is folded over onto itself, thereby providing a two-ply construction. The inner portions of the fold of tab member 114 and edge 139 are secured to each other with a suitable adhesive (not shown). If desired, edge 139 may be formed simultaneously With tab member 113 before the ramps 137, 138 are formed.

As shown in FIGS. 4 and 5, reinforcement layer 142 is applied along outer surfaces 133, 135 of front and rear panels 111, 112, respectively, to left portions 117, 125, respectively, and over fold line 113. Preferably, reinforcement layer 142 is a Continuous piece of plastic film that is about two inches wide.

Another reinforcement layer 141 is applied to both sides of tab member 114. Preferably, this reinforcement layer 141 is a plastic film that extends about one inch on each side of tab member 114.

Finally, yet another reinforcement layer 140 is applied along both sides of the right edge of front panel 111. It is not necessary for reinforcement layer 142 to overlap either reinforcing layers 140 or 141. Also, reinforcing layer 140 comprises a plastic film that extends along the right edge 120 of the front panel 111 by approximately one quarter inch on each of outer 133 and inner 134 surfaces.

The plastic film utilized as the reinforcement layers preferably includes a pressure sensitive adhesive backing to facilitate application to the folder. Conventional transparent adhesive tape of the appropriate width and length can be used. A preferred material is a polyester tape manufactured by DuPont and sold under the trademark MYLAR.

Although plastic film is preferred, other types of reinforcement layers such as paper or cardboard can be used, if desired. To further improve the resistance of paper or cardboard reinforcement layers to finger oils or moisture, the layer can be treated with a suitable coating.

One coating that may be utilized is an acrylic polymer. This coating may be applied by a flexigraphic printing process with the coating material in the form of a water based emulsion. These coatings and their application processes are generally known to one skilled in the art and need not be described in detail here. The coated or uncoated reinforcement layers are then adhesively attached to the appropriate locations using the same type adhesive utilized to join the folded portions of the tab edge. Such adhesives are also well known to one skilled in the art.

Another type of reinforcement layer is a polymer which is deposited directly on the appropriate portions of the folder by, for example, a screen printing process.

It is to be understood that, in general, the thicker or heavier the reinforcement layer is, the greater the durability and useful service life of the folder. In addition, each reinforcement layer may be the same or different, and one skilled in the art can conduct routine tests to determine which combinations are the most advantageous for any particular folder or folders.

It is also typical for conventional file folders to include a plurality of linear depressions to provide a plurality of crease lines for forming one or more fold lines. Thus, the additional fold lines allow for expansion of the folder by forming a fold line on each of the front and rear panels with the fold lines connected by a base portion. When multiple depressions are provided, the width of the base portion can be selected to provide the desired width of the folder. The two preferred embodiments of the present invention also contemplate this feature so that the width of the folder can be selected in an attempt to avoid overstuffing. When a plurality of crease lines are included, reinforcement layer 42, 142 would cover the base portion and each crease line and then extend out to the outer portion of the front and rear panels. Thus, the base portion and crease lines will be protected from premature wearing as the folder is placed on and removed from the shelf.

Finally, if desired, the reinforcement layers can be made of a color which contrasts with the front and rear panels to enable a color coded file system to be obtained. In addition, each reinforcement can be made of a different color to further expand the file system. These systems can be designed in a variety of such combinations by one skilled in the art.

According to the provisions of the Patent Statutes, we have explained the principle and preferred construction of the present invention and have illustrated and described what we now consider to represent its best embodiments. However, it should be understood that within the scope of the appended claims, the invention may be practiced otherwise than specifically illustrated and described.

We claim:

1. A reinforced shelf filing folder comprising:

front and rear panel members each having first and second surfaces and side edges, said panel members joined along a fold line, and a tab member having first and second surfaces and extending along a first side edge of the rear panel member;

first reinforcing means applied to both the first and second surfaces of the tab member; and second reinforcing means applied to the fold line and onto a portion of the adjacent first surfaces of the front and rear panel members;

wherein the first and second reinforcing means increase the wear resistance and useful life of the folder.

2. The shelf filing folder of claim 1 which further comprises third reinforcing means applied to the first surfaces of the front and rear panel members, the third reinforcing means being disposed along the first surface of the rear panel member adjacent a side edge opposite the first side edge and extending over the fold line onto the first surface of the front panel member.

3. The self filing folder of claim 2, wherein the first, second, and third reinforcing means do not overlap each other.

4. The shelf filing folder of claim 1, which further comprises an undercut edge extending along the first side edge of the rear panel member adjacent the tab member and over the fold line to the front panel member.

5. The shelf filing folder of claim 4, wherein the undercut edge is formed from an extension of the front panel member that is folded over onto itself to form flaps that are secured to each other with an adhesive.

6. The shelf filing folder of claim 4, wherein the undercut edge forms ramp means to facilitate removal of the folder from a shelf.

7. The shelf filing folder of claim 6, wherein the ramp means has an arcuate shape which tapers from the fold line to the first side edge of the front and rear panel members.

8. The shelf filing folder of claim 1, wherein the second reinforcing means extends to a second side edge of the front and rear panel members, and does not overlap the first reinforcing means.

9. The shelf filing folder of claim 1, further comprising third reinforcing means applied to the first and second surfaces of the front panel member along the first side edge.

10. The shelf filing folder of claim 1, wherein one of the front or rear panel member has a linear depression which provides a crease line for forming at least one additional fold line to allow for expansion of the folder.

11. The shelf filing folder of claim 10 wherein each of the front and rear panel members has a linear depression to provide two crease lines for expanding the folder, the crease lines being connected by a base portion, wherein the second reinforcement means extends beyond each crease line and the base portion.

12. The shelf filing folder of claim 1, wherein the tab member is formed from an extension of the front panel member that is folded over onto itself to form flaps that are secured to each other with an adhesive.

13. The shelf filing folder of claim 1, wherein the first and second reinforcing means each comprise a plastic film or a paper or cardboard strip secured to the folder, or a polymer adhered to the folder.

14. The shelf filing folder of claim 13 wherein the paper or cardboard strip includes a coating to improve its resistance to oils or moisture.

15. A reinforced shelf filing folder comprising:

front and rear panel members each having first and second surfaces and side edges, said panel members joined along a fold line, and a tab member having first and second surfaces and extending along a first side edge of the rear panel member;

first reinforcing means applied to both the first and second surfaces of the tab member;

second reinforcing means applied to the fold line and onto a portion of the adjacent first surfaces of the front and rear panel members; and third reinforcing means applied to the first surfaces of the front and rear panel members, the third reinforcing means being disposed along the first surface of the rear panel member adjacent a side edge opposite the first side edge and extending over the fold line onto the first surface of the front panel member;

wherein each of the first, second and third reinforcing means comprises a plastic film which is attached to the folder to increase the wear resistance and useful life of the folder.

16. The self filing folder of claim 15, wherein the first, second, and third reinforcing means do not overlap each other.

17. The shelf filing folder of claim 15, wherein at least one of the first, second and third reinforcing means imparts a color to the folder.

18. The shelf filing folder of claim 15, wherein each of the first, second and third reinforcing means is of a different color.

19. The shelf filing folder of claim 15, which further comprises an undercut edge extending along the first side edge of the rear panel member adjacent the tab member and over the fold line to the front panel member.

20. The shelf filing folder of claim 19, wherein the undercut edge is formed from an extension of the front panel member that is folded over onto itself to form flaps that are secured to each other with an adhesive.

21. The shelf filing folder of claim 15, wherein one of the front or rear panel member has a linear depression which provides a crease line for forming at least one additional fold line to allow for expansion of the folder.

22. The shelf filing folder of claim 15, wherein each of the front and rear panel members has a linear depression to provide two crease lines for expanding the folder, the crease lines being connected by a base portion, wherein the second reinforcement means extends beyond each crease line and the base portion.

23. A reinforced shelf filing folder comprising:

front and rear panel members each having first and second surfaces and side edges, said panel members joined along a fold line, and a tab member having first and second surfaces and extending along a first side edge of the rear panel member;

first reinforcing means applied to both the first and second surfaces of the tab member;

second reinforcing means applied to the fold line and onto a portion of the adjacent first surfaces of the front and rear panel members; and an undercut edge extending along the first side edge of the rear panel member adjacent the tab member and over the fold line to the front panel member, the undercut edge forming ramp means to facilitate removal of the folder from a shelf;

wherein each of the first and second reinforcing means comprises a plastic film which is attached to the folder to increase the wear resistance and useful life of the folder.

24. The shelf filing folder of claim 23, wherein the ramp means has an arcuate shape which tapers from the fold line to the first side edge of the front and rear panel members.

25. The shelf filing folder of claim 24, wherein the second reinforcing means extends to a second side edge of the front and rear panel members, and does not overlap the first reinforcing means.

26. The shelf filing folder of claim 25, further comprising third reinforcing means applied to the outer and inner sides of the front panel member along the first side edge, wherein the third reinforcing means comprises a plastic strip which is attached to the folder.

27. The shelf filing folder of claim 26, wherein at least one of the first, second and third reinforcing means imparts a color to the folder.

28. The shelf filing folder of claim 26, wherein each of the first, second and third reinforcing means is of a different color.

29. The shelf filing folder of claim 23, wherein one of the front or rear panel member has a linear depression which provides a crease line for forming at least one additional fold line to allow for expansion of the folder.

30. The shelf filing folder of claim 23, wherein each of the front and rear panel members has a linear depression to provide two crease lines for expanding the folder, the crease lines being connected by a base portion, wherein the second reinforcement means extends beyond each crease line and the base portion.

* * * * *